United States Patent [19]

Gretler

[11] 4,100,778

[45] Jul. 18, 1978

[54] KEY WITH TRANSVERSE SLOTS AND METHOD OF MAKING SAME

[75] Inventor: Heinrich Gretler, Hinwil, Switzerland

[73] Assignee: Bauer Kaba AG Sicherheits-Schliessyteme, Wetzilon, Switzerland

[21] Appl. No.: 732,094

[22] Filed: Oct. 13, 1976

[30] Foreign Application Priority Data

May 20, 1976 [CH] Switzerland ..... 6380/76

[51] Int. Cl.[2] ..... E05B 27/04

[52] U.S. Cl. ..... 70/406; 70/358

[58] Field of Search ..... 70/358, 364 A, 378, 70/393, 402, 405, 406

[56] References Cited

U.S. PATENT DOCUMENTS 3,349,587 10/1967 Keller ..... 70/406

3,412,588 11/1968 Schwegler ..... 70/406

3,889,501 6/1975 Fort ..... 70/405

FOREIGN PATENT DOCUMENTS 8,829 11/1913 United Kingdom ..... 70/364 A

*Primary Examiner*—Robert L. Wolfe

*Attorney, Agent, or Firm*—Roylance, Abrams, Berdo & Farley

[57] ABSTRACT

A key for use with a cylinder lock of the type having tumbler pins protruding into the key slot perpendicularly and at inclined angles wherein elongated recesses to receive the pins are formed in the key with the long dimensions of the recesses extending transversely across the key. The recesses are successively formed with a single conical-tipped cutter shaped like the tumbler pins. The cutter is moved in a U-shaped path into, across and away from the key, leaving sloping sides which form good slide paths for the pins. The recesses can have different depths and can merge stepwise into each other.

5 Claims, 7 Drawing Figures

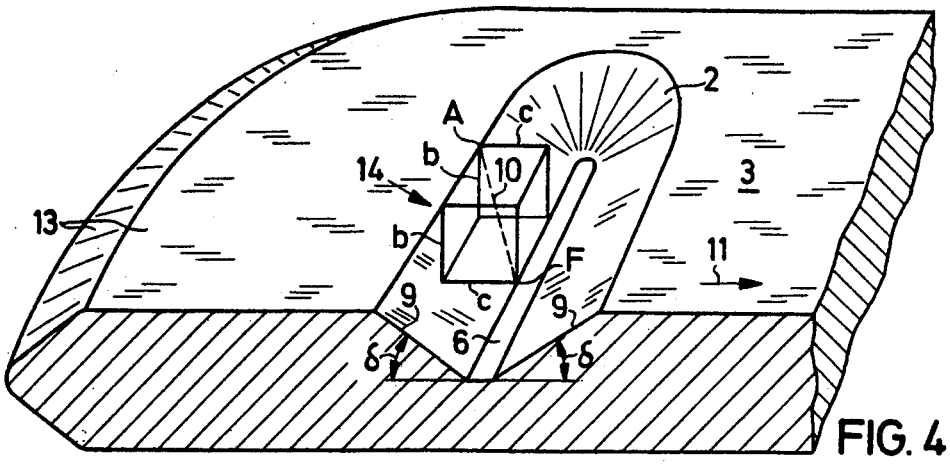
FIG. 4
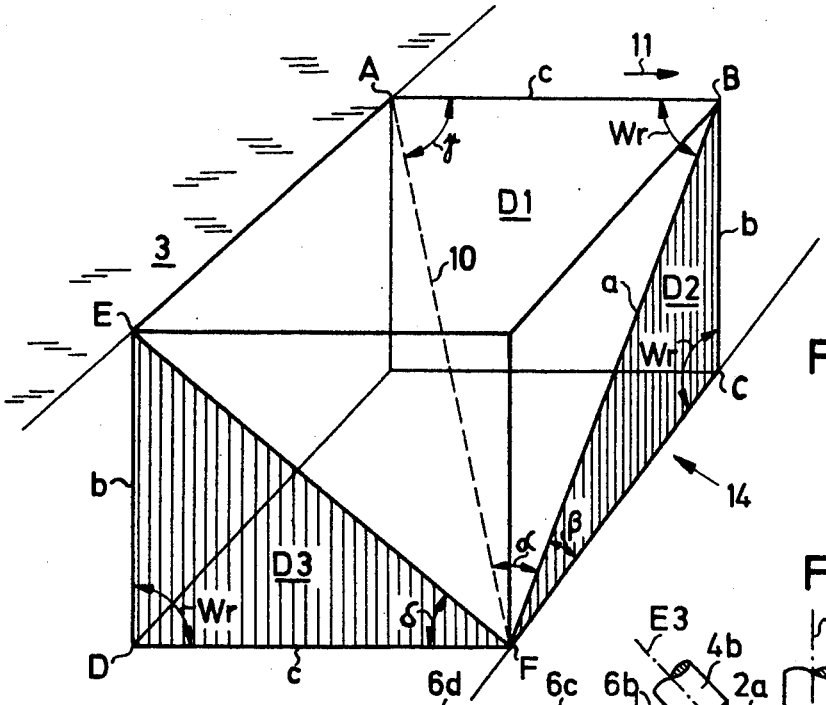
FIG. 5
FIG. 7
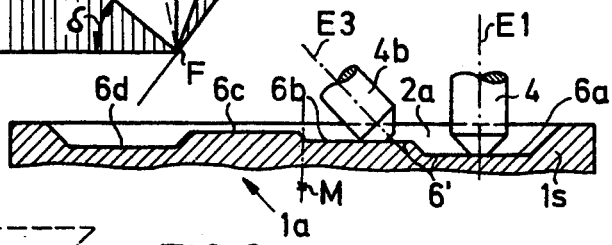
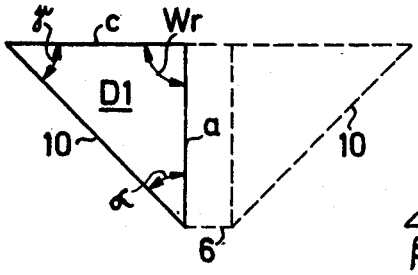
FIG. 6
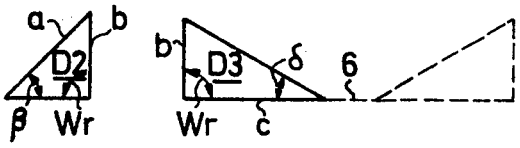

KEY WITH TRANSVERSE SLOTS AND METHOD OF MAKING SAME

This invention relates to a key for a cylinder lock with recesses for tumblers inclined relative to the key surface, and to a method for manufacturing the key.

BACKGROUND OF THE INVENTION

In hitherto known flat keys of this type the cylinder rotor tumbler pins inclined preferably by an angle of 45° to the surface of the key inserted in the key slot, form with the associated key recesses an additional permutation to the conventional 90° lateral permutation formed by the tumbler pins located in perpendicular manner on the key surface and the key recesses belonging thereto. The key recesses follow one another in rows, each set of recesses running in the longitudinal direction of the flat key, each set belonging to one of the various tumbler planes. Thus, the sets of recesses are successively drilled into, or milled from, the two flat sides of the key. As is known in the prior art, it is necessary for this purpose to have a special drilling or milling spindle for each tumbler plane depending upon its slope angle relative to the key surface, i.e., a multiple-spindle machine tool with three main spindles for manufacturing flat keys constructed as turning keys. While such machines admittedly produce optimum slides on the sides of the recesses for the removal of the tumbler pins from the recesses, accompanied by limited space requirements for the recesses on the key shank, their construction is complicated and therefore expensive to produce.

BRIEF SUMMARY OF THE INVENTION

An object of the invention is to obviate this disadvantage.

According to the invention this problem is solved by a key of the type defined hereinbefore which is provided with elongated recesses and wherein the longer dimensions of the elongated recesses of the key extend at right angles to the longitudinal axis of the key shank.

The invention also relates to a method for manufacturing the key, wherein the recesses are successively milled in the key shank by means of a milling spindle which is perpendicular to the key surface and which is caused to move in a main feed direction which is perpendicular to the longitudinal axis of the key for each recess.

BRIEF DESCRIPTION OF THE DRAWINGS

Other and further objects of the present invention will be apparent from the following description and claims and are illustrated in the accompanying drawings, which form a part of this specification and, by way of illustration, show preferred embodiments of the present invention and the principles thereof and what are now considered to be the best modes contemplated for applying these principles. Other emobdiments of the invention employing the same or equivalent principles may be used and structural changes may be made as desired by those skilled in the art without departing from the present invention and the scope of the appended claims. In the drawings.

FIG. 4 is an enlarged three-dimensional perspective view of half of the tip of the key according to FIG. 1, with an imaginary spatial auxiliary body for purposes of explanation;

FIG. 5 is an enlarged three-dimensional view of the spatial auxiliary body according to FIG. 4;

FIG. 6 is an explanatory diagram of three triangles from the spatial auxiliary body of FIG. 5, in each case in the drawing plane; and FIG. 7 is a partial end elevation, in partial section, of a turning key with a transverse recess having a plurality of step depths, according to FIG. 2.

DETAILED DESCRIPTION OF THE PREFERRED EMBODIMENTS

Figure 1:
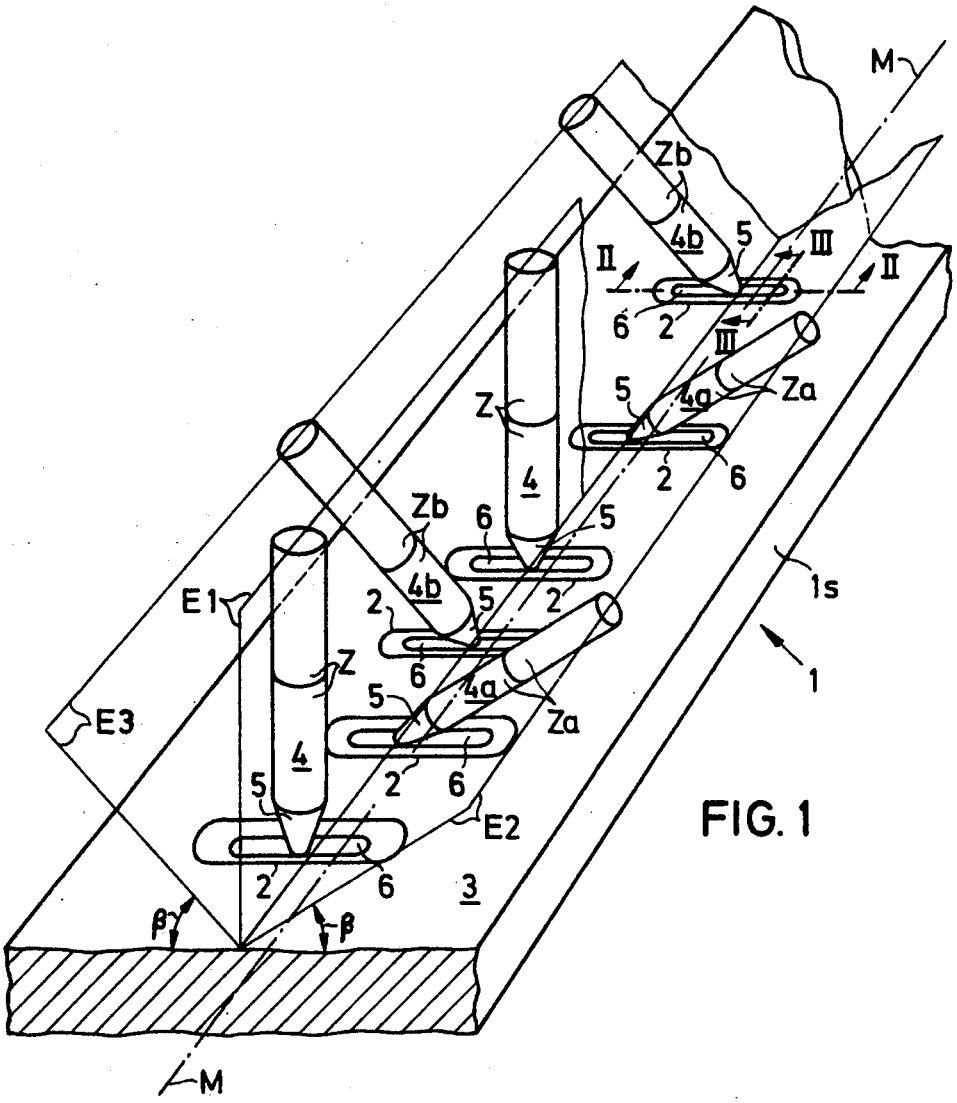
FIG. 1 is a three-dimensional partial perspective view of a key according to the invention.

In FIG. 1 a key 1 constructed as a flat key for a cylinder lock is provided on its two flat sides with oblong recesses 2, which are milled into the key shank 1*s* and extend at an angle of 90° (at right angles) to the longitudinal axis M of the key, i.e., perpendicular thereto. The recesses 2 which follow one another in the longitudinal direction of the key are here provided for the tumbler pins Z located perpendicular to the planar key surface 3, for tumbler pins *Za* inclined to the right relative to this surface and tumbler pins *Zb* inclined to the left relative thereto. The cylinderical pairs of tumbler pins of each of these three types of tumblers Z, *Za* and *Zb* are located with their axes in, in each case, a common plane, which is perpendicular to key surface 3 for tumbler Z, inclined to the right at an angle $\beta$ relative to this surface for tumbler *Za* and inclined to the left at the same angle $\beta$ relative to this surface for tumbler *Zb*, these three planes being identified as E1, E2 and E3, all of which extend in the longitudinal direction of the key. Furthermore, the axes of tumblers Z, *Za* and *Zb* are also located in planes which are perpendicular to the key surface 3 and which, in each case, extend at an angle of 90° to the longitudinal axis M of the key, and are therefore parallel to each other. With the flat key 1 fully inserted in the key channel of the cylinder lock (not shown) the tumbler pins of tumblers Z, *Za* and *Zb* are engaged in the associated transverse recesses 2 of key 1. The tumbler pins are axially displaceably mounted in radial bores of the cylinder in conventional fashion and in FIG. 1 are identified as 4, 4*a* or 4*b*. The conical tip 5 thereof then rests on the oblong base 6 of recess 2. The two planes E2 and E3 of tumblers *Za* and *Zb* inclined to key surface 3 are here inclined to the right and left, respectively, relative to key surface 3 at an angle $\oplus$ of, for example, 45°.

Figure 2:
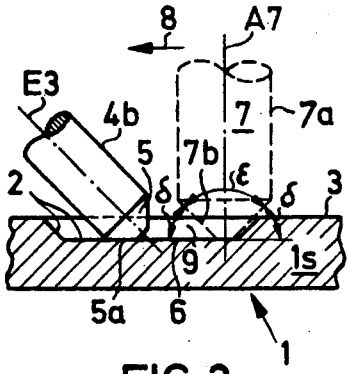
FIG. 2 is an end elevation of the key of FIG. 1, in partial section, along the line II—II of FIG. 1.

FIG. 2 shows, in section, a portion of key shank 1*s* of flat key 1 according to FIG. 1 in a lengthwise key cross-section through the transverse recess 2 for the tumbler pin 4*b* of a tumbler *Zb* inclined to the left at an angle $\beta$, i.e., located in plane E3. Transverse recess 2 is made by a milling cutter 7, indicated by dotted lines in FIG. 2, which has a cylindrical portion 7*a* and a conical tip portion 7*b* substantially identical in shape to the tumbler pins, with its axis A7 perpendicular to key surface 3. The cutter follows a downward depth feed movement during which it penetrates beneath the key surface 3 into the key material, after which it performs a main feed movement in the direction of arrow 8 at right angles to key shank 1*s*, i.e., perpendicular to the longitudinal axis M of the key (cf. FIG. 1), after which it is removed from the key surface in an upward vertical depth return movement. In FIG. 1, the cylindrical tumbler pin 4*b* engaged in the transverse recess 2 rests with a conical surface line 5*a* of its conical tip 5 on the planar, oblong base 6 of said transverse recess. Because the cylindrical part 7*a* of cutter 7 does not undercut the key surface 3, i.e., does not penetrate the key material when milling the transverse recess 2, the cutter 7 produces two planar recess sides 9 at right angles to the key shank 1*s*, i.e., located perpendicular to the longitudinal axis M of the key (cf. FIG. 1), only one of those sides being shown in the cross-sectional view of FIG. 2. The two recess sides 9 are inclined relative to key surface 3 in accordance with the cone angle of cutter tip 7*b* and, starting from the recess base 6, extend up to the planar key surface 3, whereby they form rectilinear slides 10 (cf. FIGS. 4 and 5) for the conical tip 5 of tumbler pin 4*b* inclined to the left in FIG. 1, also extending from recess base 6 up to the key surface 3. If, as is shown in FIG. 2, the cone angle $\epsilon$ of conical cutter tip 7*b* is, for example, 90°, then the two recess sides 9 are in each case inclined at an angle $\delta$ of 45° to the key surface 3 or to the recess base 6 which is parallel to the key surface (cf. also FIG. 4). What has been said regarding the transverse recesses 2 of tumbler Z*b* inclined to the left also applies to the transverse recesses 2 of the tumbler Z*a* inclined to the right (cf. FIG. 1). As regards diameter, size, outer contour and penetration depth, the milling cutter 7 corresponds to a tumbler pin 4 located perpendicular to key surface 3 and engaged in its transverse recess of a tumbler Z which is perpendicular to key surface 3 (cf. FIG. 1).

Thus, by means of a single milling spindle operating perpendicularly to the key surface 3 and using the same milling cutter 7, the milling process makes it possible to produce both the transverse recesses 2 for the tumbler pins 4*a* and 4*b* of the tumblers Z*a* and Z*b* inclined to the left or right relative to key surface 3 and also those for the tumbler pin 4 of the tumbler Z which are perpendicular to the key surface 3. While the slides for the tumbler pin 4 which are perpendicular to the key surface 3 are in a plane which is perpendicular to said key surface 3 and extends in the longitudinal direction of the key, the slides 10 for the tumbler pins 4*b* inclined to the left relative to surface 3 are inclined (cf. FIGS. 4 and 5), this also being true for the slides of the tumbler pins 4*a* inclined to the right relative to key surface 3 (cf. FIG. 1).

Figure 3:
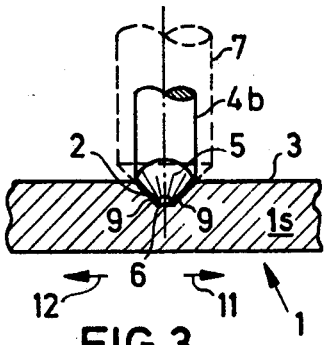
FIG. 3 is a partial side elevation along the line III—III of FIG. 1.

FIG. 3 shows a cross-section of the transverse recess of FIG. 2, i.e., in a longitudinal section of the particular portion of the key shank 1*s* of FIG. 1. In this view it is possible to see the two planar recess sides 9 extending at right angle to key shank 1 and which serve to form the two linear slides 10 extending up to the key surface 3 (cf. FIGS. 4 and 50 for the conical tip 5 of the tumbler pin 4*b* inclined relative to said key surface 3 (cf. also FIGS. 1 and 2).

On removing the flat key 1 in the direction of arrow 11, the tumbler pin 4*b* with its conical tip 5 engaged in transverse recess 2 rises from the recess base 6 and up the recess side 9 which is to the left in FIG. 3 and onto the key surface 3, whereupon it is disengaged from the recess. On inserting the key in the direction of arrow 12, the tumbler pin slides from the key surface 3 along said recess side 9 down to the recess base 6 and thereby engages in recess 2. For comparison with FIG. 2, FIG. 3 once again shows the milling cutter 7 in dotted lines.

If the transverse recess 2 shown in FIGS. 2 and 3 is the recess which is farthest from the key tip 13 (cf. FIG. 4), i.e., is closest to the key handle member, then the right-hand recess side 9 in FIG. 3 performs no function relative to the associated tumbler pin 4*b*. However, if this recess is a preceding transverse recess, i.e., is one of the recesses located closer to key tip 13, then the right-hand recess side 9 in FIG. 3 serves, on inserting the key 1 in the direction of arrow 12, to cleanly remove from the cylinder rotor the "extraneous" tumbler pins located therein closer to the rotor and in front of the associated tumbler pin 4*b*. In fact, during the key insertion movement, said "extraneous" tumbler pins only pass by the recess, but, under the pressure of their tumbler springs, temporarily engage therein.

FIG. 4 shows a three-dimensional view of half the key tip 13 of flat key 1 according to FIG. 1 with its farthest forward transverse recess 2. A rectilinear slide path 10, shown by dotted lines in FIG. 4 and formed by the left-hand recess side 9 in FIG. 4 and serving to remove the tumbler pin 4*b* of a tumbler Z*b* inclined to the left by an angle $\beta$ relative to the key surface 3 (cf. FIGS. 1 and 2), extends from the base point F of recess base 6, located in the recess side plane, rectilinearly in an inclined upward direction to a point A at the key surface 3. On the basis of the two points F and A, and the straight slide path or line 10 connecting those points as a three-dimenisonal diagonal, one can envision for purposes of explanation a small spatial auxiliary body 14 having a prismatic shape in the form of a three-dimensional parallelepiped block, which is also called a "rectangular parallelepiped." The body is shown in FIG. 4 as a transparent body with all its 12 edges and six plane surfaces shown perspectively. In FIG. 4 this parallelepiped 14 is bounded on the front and rear by two identical parallel rectangular surfaces each bounded by edges *b* and *c*, located in two planes extending parallel to one another in the longitudinal direction of the key and positioned perpendicular to key surface 3. The four remaining rectangular surfaces of parallelepiped 14 are parallel to one another in pairs, two being perpendicular to key surface 3 and also perpendicular to the longitudinal axis M of the key, and the other two surfaces being parallel thereto, i.e., are located in the plane of surface 3 itself or in the plane or recess base 6. The slope angle at which the two planar recess sides 9 are inclined relative to the plane or recess base 6 is designated in FIG. 2 and 4 by $\delta$. If, in accordance with the 90° conical tip 7*b* of milling cutter 7 of FIG. 2, the two recess sides 9 are each inclined at an angle $\delta$ of 45° relative to recess base 6, then edge dimension *b* of the parallelepiped is the same as edge dimension *c*, so that the front and rear rectangular surface $b \times c$ of parallelepiped 14 extending in the longitudinal direction of the key are then square.

The imaginary spatial auxiliary body 14 according to FIG. 4 in the form of a parallelepiped is used for the mathematical determination of the angle of inclined rectilinear slide 10 for the tumbler pin 4*b* of a tumbler Z*b* inclined at an angle $\beta$ relative to key surface 3 (cf. FIGS. 1 and 2). For this purpose, FIG. 5 shows the same parallelepiped 14 in three-dimensional form, but on a larger scale than in FIG. 4, and it will now be explained in greater detail trigonometrically by means of FIG. 5.

For determining the angle essential for slide 10 in the case of the parallelepiped according to FIG. 5, three right triangles are imagined, all three emanating from a common base point lying at one angle of each of the triangles. Specifically, these triangles are:

1. The triangle F–A–B designated by the reference D1 with the right angle W*r* in the corner B, the rectilinear slide 10 as the hypotenuse forming the spatial diagonal of the parallelepiped 14, the length of the associated key path in the key removal direction (11 in FIGS. 3 to 5) as the side *c*, the linear lift path of the tumbler pin (4*b* in FIGS. 1 to 3) also located in the plane of triangle F–A–B as the second side a, the angle $\alpha$ in corner F as the angle of inclination of slide 10 and the angle $\gamma$ in the corner A as the angle opposite to side *a*;

2. The triangle F–B–C designated by the reference D2 with the right angle W*r* in the corner C, with the linear lift path *a* of the tumbler pin (4*b* in FIGS. 1 to 3) as the hypotenuse *a*, the true height of recess 2 as the side *b* and the angle $\beta$ in the corner F as the true slope angle of the inclined tumbler plane (E3 in FIG. 1); and 3. The triangle F–D–E designated by the reference D3 with the right angle W*r* in the corner D the hypotenuse located in the plane of the left-hand recess side (9 in FIGS. 3 and 4), with the perpendicular height of recess 2 as the side *b* and with the length *c* of the key path in the key removal direction (11 in FIGS. 3 to 5) belonging to the length of slide 10 as the second side *c*, as well as the angle $\delta$ in the corner F as the slope angle of the recess side (9 in FIGS. 3 and 4).

By means of the trigonometric angular functions taken from these three right-angled triangles and their reciprocal interconnection, it is possible to determine the angles essential for slide 10, as can be gathered from FIG. 6 and as will be explained hereinafter.

FIG. 6 shows the three right-angled triangles D1, D2 and D3 explained relative to FIG. 5, are shown individually in their true size, wherein the two triangles D1 and D2 are rotated into the drawing plane about sides *c* and *b* respectively, triangle D3 in the three-dimensional view of the parallelepiped 14 according to FIG. 5 already being in the drawing plane and consequently not rotated. Hereinafter these three triangles D1, D2 and D3 are considered successively, so that the relevant angular functions of the planar trigonometry are formed.

Triangle D1 represents the shape of recess 2 through the vertical plane including entry and exit slide path 10 for the tumbler pin (pin 4*b* in FIGS. 1–3), two such triangles in mirror image having the recess base 6 located between them. It will be recognized that the following trigonometric relationships for this triangle exist with a normal angle of inclination 60 of 45°, in which case angle $\gamma$ = angle $\alpha$ and side $a$ = side $c$:

$$\tan\gamma = a/c$$

$$c = a/\tan\gamma$$

Triangle D2 contains the perpendicularly measured, true height *b* of recess 2 and therefore also shows the true slope angle $\beta$ of the tumbler planes (E3 in FIG. 1), giving $\sin\beta = b/a$ and $b = a\sin\beta$. Triangle D3 is a cut-away portion of the cross-sectional profile surface of recess 2 located in the longitudinal direction of the key perpendicular to key surface 3 and also contains the true height *b* of recess 2 and consequently also the true slope angle $\delta$ of the left-hand recess side (9 in FIGS. 3 and 4). This leads to $\tan\delta = b/c$ and, on applying the two equations $c = a/\tan\gamma$ and $b = a\sin\beta$ obtained from the angular functions of the two triangles D1 and D2, for the true slope angle $\delta$ of the left-hand recess side (9 in FIGS. 3 and 4):

$$\delta = b/c = (a\sin\beta)/(a/\tan\gamma)) = \tan\gamma\sin\beta$$

and therefore $$\tan\delta = \tan\gamma\sin\beta \qquad \text{EQ. 1}$$

On the basis of the three-dimensional geometrical analysis of a transverse recess 2 and the associated parallelepiped 14, imagined in the form of a spatial auxiliary body, carried out with reference to FIGS. 4 to 6, two typical cases will now be calculated as examples of the significance of these angles.

The first example will deal with the relationships for optimum sliding conditions for tumbler planes located perpendicular to the key surface 3 and inclined relative thereto (E1, E3 in FIG. 1).

The second example relates to the sliding conditions when using a milling cutter 7 with a 90° conical tip 7*b* (cf. FIG. 2).

In this connection the following basic equations are used:

$$\tan\delta = \tan\gamma\sin\beta \qquad \text{EQ. 1}$$

In addition, from FIGS. 2 it will be seen that $$\epsilon = 180° - 2\delta \qquad \text{EQ. 2}$$

EXAMPLE 1

Given:

Slope angle $\beta = 45°$ for the inclined tumbler plane E3; and

Angle of inclination $\gamma = \alpha = 45°$

Sought:

Angle $\delta$ and, from this, the milling cutter angle $\epsilon$.

$$\tan\delta = \tan\gamma\sin\beta = 1 \times 0.707 = 0.707 \qquad \text{EQ. 1}$$

$$\delta = 35°15'$$
$$\epsilon = 180° - 2\delta \qquad \text{EQ. 2}$$

$\epsilon = 180° = 2(35°15')$ = cone angle at cutter 7 (cf. FIG. 2)

$\epsilon = 180°00' - 70°30' = 109°30'$

The slope angle $\delta$ = approximately 35° for the slope of the recess side (9 in FIG. 4) and therefore also for the slides of tumbler pins 4 in the tumbler planes arranged perpendicularly to the key surface 3 (E1 in FIG. 1) is therefore smaller than 45° and, therefore, more advantageous in connection with the force which has to be applied thereto on inserting and removing the key. During the constantly reocurring lifting of the tumbler pins, quite apart from the elastic counterpressure of the tumbler springs, this force is dependent on the slope of the associated slide surfaces relative to the key surface 3. It will be seen that at the relatively small side angle $\delta$ of only approximately 35°, the transverse recess 2 at key surface 3 in the longitudinal direction of the key is wider than in the case of an angle $\delta$ of 45°.

EXAMPLE 2

Given:

Milling cutter angle $\epsilon = 90°$ and therefore $\delta = 45°$ (cf. equation 2 and FIG. 2)

Slope angle $\beta = 45°$ for inclined tumbler plane E3

Sought:

Slope angle $\gamma$ for tumblers in plane E3.

$$\tan \delta = \tan \gamma \sin \beta \qquad \text{EQ. 1}$$

$$\tan \gamma = \tan \delta / \sin \beta = 1/0.707 = 1.414$$

$$\gamma = 54°44'$$

Thus, when using a cutter with a tip angle $\epsilon$ of 90°, an angle of inclination $\gamma$ of approximately 55° is obtained for the inclined tumbler plane E3, which is therefore larger than 45°, leading to a steeper slide which consequently increases the insertion or removal force relative to the key and, consequently, also wear. Furthermore, at the angle $\delta$ of 45°, the transverse recess 2 at key surface 3 in the longitudinal direction of the key is narrower than at an angle $\delta$ of only approximately 35°, as was previously obtained in Example 1 for the inclination of recess side 9 relative to key surface 3 (cf. FIG. 4).

FIG. 7 shows a flat key 1*a*, constructed as a turning key, in a cross-section of the key shank 1*s* corresponding to FIG. 2. In this case a transverse recess 2*a* has a recess base 6', having different step depths 6*a*, 6*b*, 6*c* and 6*d*, formed by different levels. This corresponds to the conventional turning key with a double drill pattern, relative to which on each of the two flat sides of the key there are four rows of recesses, whereby on each key side two rows of recesses on one-half of the key have so-called "active" recesses, whereas the two other rows of recesses on the other half of the key have "inactive" recesses, which only become "active" when the key is turned by 180° in the key groove. For example, in FIG. 7 the portion of the transverse recess 2*a* located on the right-hand half of the key forms the two "active" recess steps 6*a* and 6*b*, as shown in FIG. 7 by using a cutter reproducing the associated engaged tumbler pins 4 and 4*b*. The tumbler pin 4 belongs to a tumbler whose axis is in a tumbler plane E1 perpendicular to the key surface 3, whereas the tumbler pin 4*b* belongs to a tumbler whose axis is in a tumbler plane E3 inclined to the left relative to key surface 3 (cf. FIG. 1). Correspondingly, the two, in this case "inactive" recess steps 6*c* and 6*d* on the left-hand half of the key belong to two associated tumblers, which are perpendicular to key surface 3 or are inclined relative thereto, in the cylinder rotor on the other side of the key slot.

The transverse recess 2*a* of FIG. 7, whose base 6', unlike in FIGS. 1 and 2, is recessed in step-like manner, can be produced with the same milling cutter as in FIG. 2, but in this case during its main feed movement at right angles to key shank 1*s*, i.e., perpendicular to the longitudinal axis M of the key, the cutter 7 is controlled with a sequence of depth return or depth feed movements corresponding with the individual steps for producing the various step depths, which can be achieved by means of a previously programmed milling machine. With reference to the cylinder rotor the axial planes of the tumblers arranged on both sides of the key groove and located perpendicular to the cylinder axis can be displaced relative to one another on the key for rotor stability and space saving reasons. In this case, in place of transverse recesses 2*a* with four step depths on turning key 1*a*, recesses with only two step depths are obtained.

Diverging from FIG. 1, the sequence of perpendicular tumbler Z on key surface 3 and tumbler Z*a* or Z*b* inclined to the right or left relative to this surface in the longitudinal direction of the key can also differ. Furthermore, diverging from FIG. 1 where the transverse recesses 2 are staggered somewhat relative to one another at right angles with the key shank 1*s*, it is also possible for the two recess ends to be located in common alignment in the longitudinal direction of the key. However, it should be noted in connection with the embodiment of FIG. 1 that each recess side 9 extending at right angles to key 1 of the transverse recesses 2 located in the vicinity of the key tip (13 in FIG. 4), on inserting the key 1, permits tumbler pins to slide down or rise up relative to the three tumbler planes E1, E2 and E3, i.e., three slides of different direction and inclination and also different length, in connection with the tumbler pins of the perpendicular tumbler plane E1 compared with those of the two inclined tumbler planes E2 and E3. This feature is not obtained with conventional key recesses, because hitherto the tumbler pins of the same tumbler type, e.g., those of a 90° lateral permutation in each case only pass over like "specific" recesses. It is also possible, diverging from FIGS. 1 to 3, to conceal the center of the actual tumbler position of the tumbler pins in the longitudinal direction of the key by making the transverse recesses in said direction wider than necessary, i.e., by milling into the key shank with a milling cutter of correspondingly larger diameter than that of a tumbler pin (4 in FIG. 1) perpendicular to the key surface. Starting from the tumbler surface of the transverse recesses, it is advantageous to "extend" them only on one side in the longitudinal direction of the key member, thus permitting the recess flank serving as a slide for the tumbler pins and located on the side of the recesses facing the key tip to simultaneously serve as the supporting side for limiting longitudinal movement upon pulling of the inserted key, but which has been turned somewhat from its insertion or removal position, as described in Swiss patent application No. 11821/75 (U.S. patent application Ser. No. 720,783, filed Sept. 7, 1976). The key need not be a flat key. In fact, random other key flank cross-sections can be used, e.g., a cross-section with a radial arrangement of the effective key faces.

The invention is not limited to the embodiments shown in the drawings and, in fact, the constructional details can be varied within the scope of the invention. An important advantage of the key according to the invention is that it can now be manufactured by means of a single-spindle milling machine, whereas hitherto a multiple spindle machine tool with, in fact, three main spindles was necessary for the manufacture of flat keys, constructed as turning keys with a 90° lateral permutation and a 45° additional permutation. It is now possible to manufacture such flat keys not only with a single milling spindle, but with one and the same milling cutter. In addition, the further advantage is provided in that the true center of the tumbler positions is concealed by the two-sided extension of the recesses. This is obtained as a "bonus" with the construction according to the invention, because the transverse recesses are all extended on both sides and always in the direction at right angles to the key shank (cf. FIG. 1), because milling takes place at right angles to the key and therefore the end surfaces of the transverse recesses located in the vicinity of the key edges are now even touched by the tumbler pin and certainly do not serve the removal or engagement of tumbler pins or as a supporting surface for the associated tumbler pin.

The invention is not limited to the embodiments described hereinbefore relative to the drawings, and numerous variations thereof are possible without passing beyond the scope of the invention as defined in the appended claims.

What is claimed is:

1. A key having an elongated substantially rectangular shank portion for use in combination with a cylinder lock of the type having a generally rectangular key slot for receiving the shank portion and a plurality of sets of tumbler pins, at least one of said sets being inclined relative to a side of said slot, the key comprising means in at least one surface of said shank portion defining a plurality of elongated recesses for receiving the distal ends of tumbler pins in said sets, the longer dimensions of each of said recesses extending transversely perpendicular to the longitudinal insertion direction of said shank portion, said recesses having base surfaces spaced from said one surface, the spacing of selected ones of said base surfaces from said one surface being significantly different from the spacing of the remaining ones of said base surfaces from said one surface.

2. A key according to claim 1 for use with a lock in which the tumblers include tumblers movable along axes perpendicular to the key surface, wherein said key further comprises means defining a second plurality of elongated recesses in a surface of said shank for receiving said perpendicularly movable tumblers, the longer dimensions of said second plurality of recesses also extending transversely perpendicular to the longitudinal dimension of said shank portion, all of said recesses having side walls having the same slope relative to the shank surface.

3. A key according to claim 2 wherein each of said recesses in said second plurality of recesses is disposed between two recesses for receiving tumblers movable along axes inclined relative to said key surface on opposite sides of said perpendicularly movable tumblers.

4. A key according to claim 1 and constructed as a turning key wherein said recesses are arranged to receive tumblers movable along axes lying in planes perpendicular to and inclined relative to said key surface, and wherein said recesses further include intermediate wall portions extending between base surfaces of adjacent ones of said recesses so that said recesses proceed from one to another in step-like manner.

5. A key according to claim 1 wherein said recesses have inclined sides extending transversely across said key shank and wherein the included angle between said sides is at least 100° when the angle of inclination of said inclined set of tumbler pins is about 45°.

* * * * *